United States Patent [19]

Wigdahl

[11] 4,240,362

[45] Dec. 23, 1980

[54] BOILER FOR DOMESTIC HEATING SYSTEMS

[76] Inventor: Arthur G. Wigdahl, 168 S. Leonard St., West Salem, Wis. 54669

[21] Appl. No.: 964,432

[22] Filed: Nov. 28, 1978

[51] Int. Cl.[3] ..... F23B 7/00

[52] U.S. Cl. ..... 110/234; 122/20 A; 122/33; 126/151

[58] Field of Search ..... 122/20 A, 20 B, 37, 122/33, 115, DIG. 14, 4 A; 110/317, 300, 234; 126/144, 147, 151

[56] References Cited

U.S. PATENT DOCUMENTS

| | | | |
|---|---|---|---|
| 696,937 | 4/1902 | Burger et al. | 110/300 |
| 1,087,266 | 2/1914 | Turner | 122/20 A |
| 1,133,612 | 3/1915 | Brown | 126/145 |
| 1,649,610 | 11/1927 | McGuane | 122/20 A |

*Primary Examiner*—Edward G. Favors

*Attorney, Agent, or Firm*—B. P. Fishburne, Jr.

[57] ABSTRACT

A compact rectangular boiler for hot water heating systems serves as a booster or helper boiler but can be used in some cases as a primary boiler. A boiler power module consisting of fire tubes and a surrounding water chamber is readily removable like a sliding drawer for cleaning and repair, when necessary. Beneath the boiler power module is a sturdy refractory lined fire box for burning wood or other solid fuel including a cast iron grate. Beneath the grate is a readily removable ash receiving drawer or pan. The boiler power module may employ an alternate heating source in the form of an electrical heating element. Forced draft and manual draft arrangements are included.

5 Claims, 6 Drawing Figures

FIG. 4
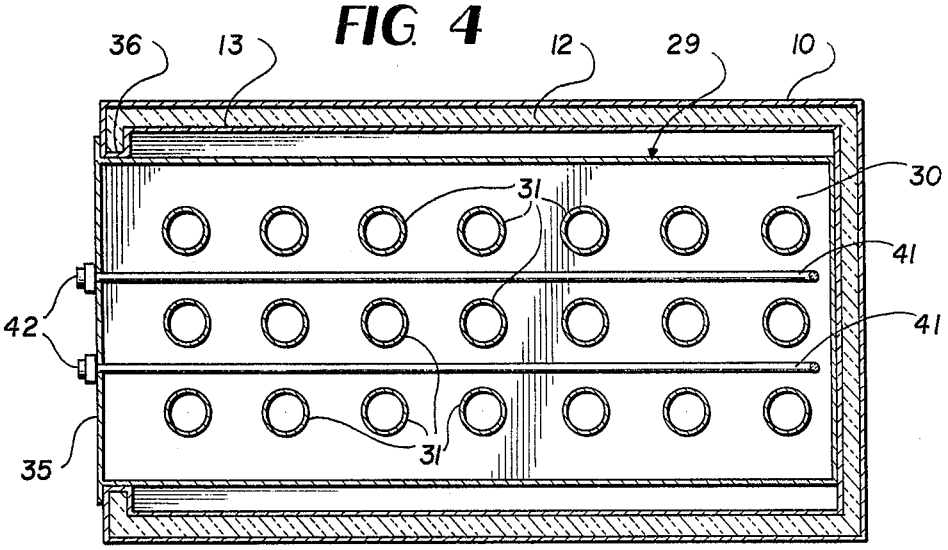
FIG. 5
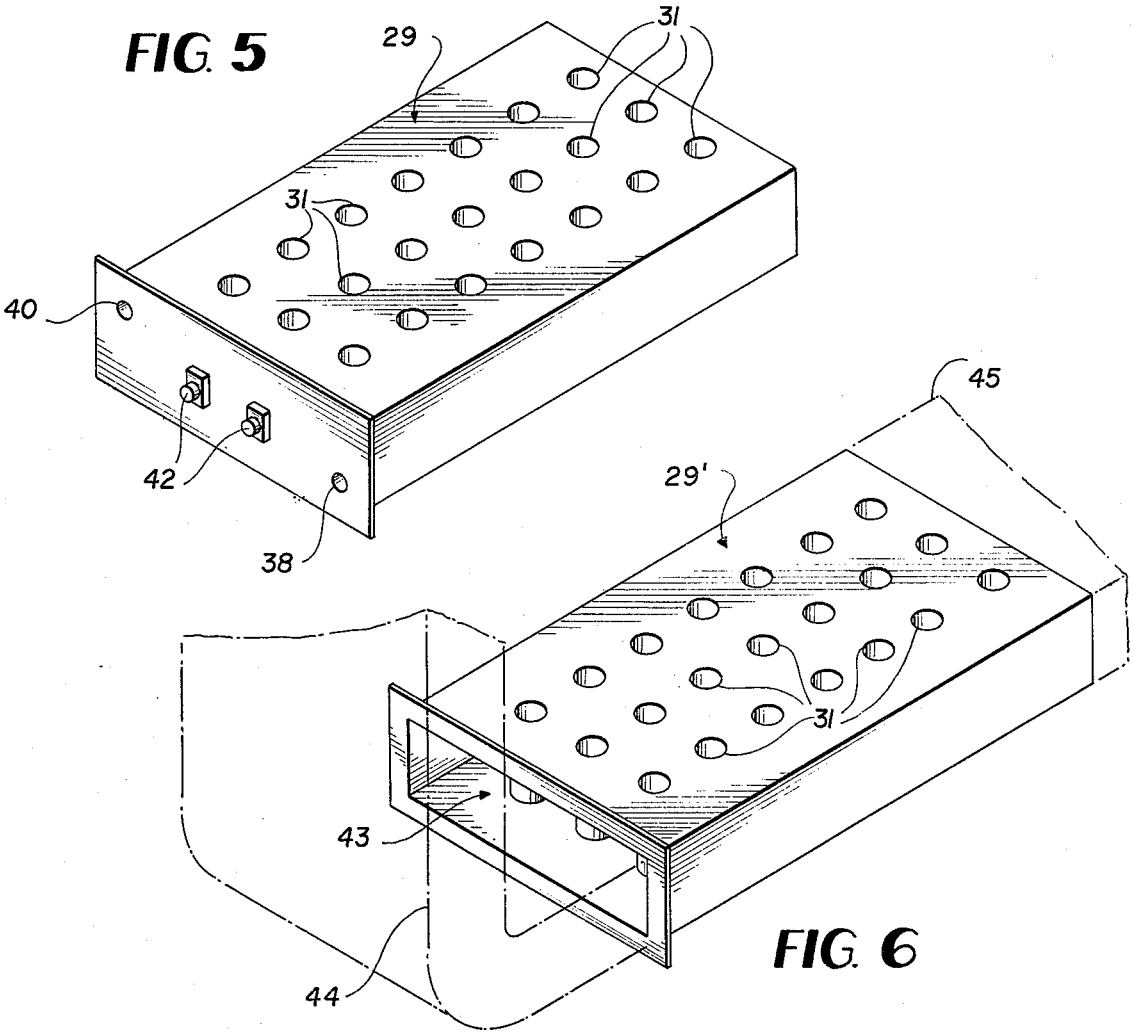
FIG. 6

BOILER FOR DOMESTIC HEATING SYSTEMS

BACKGROUND OF THE INVENTION

The current shortages of gas and oil and the high cost of such fuels has stimulated a demand for boilers and furnaces capable of burning comparatively low cost solid fuels such as wood, whereby such boilers and furnaces can be utilized as booster sources of heat in domestic heating systems and, in some cases, may be used as primary heating units.

The present invention seeks to satisfy the above need through the provision of a simplified compact and efficient boiler particularly adapted for use in domestic hot water heating systems and also capable of more general utility. The boiler is rectangular in the interest of space conservation and maximized heating capacity. It possesses an upper horizontal slide-in, slide-out power module to facilitate cleaning and maintenance and this module is a rectangular unit consisting of rows of fire tubes assembled in sealed relationship with a water chamber which surrounds the fire tubes in heat exchange relationship therewith. The water chamber connects directly at the rear of the boiler to cold water return and hot water supply lines. An electrical heating element or elements may also be included on the power module to impart to the boiler a secondary method of heating.

Other important features of the invention are embodied in a unique fire box having simplified and sturdy means to support a cast iron grate and upwardly diverging refractory side walls formed of replaceable fire bricks. An ash removal drawer is arranged below the grate and a horizontal draft tube extending in the back-to-front direction is provided immediately below the grate. A large front access door for the fire box including a draft check makes the feeding of wood into the fire box an easy operation and a separate ash clean-out door with a manual draft device is also provided on the front of the boiler.

Other important features of the invention will become apparent during the course of the following detailed description.

The following U.S. Pat. Nos. are made of record herein under 37 C.F.R. 1.56, but these patents do not possess the above-enumerated features of the present invention coacting in a manner to be described herein for obtaining the operational results of this invention: 1,967,883, 2,553,302, 3,527,260.

BRIEF DESCRIPTION OF THE DRAWINGS

FIG. 4 is a horizontal section taken on line 4—4 of FIG. 3.

FIG. 5 is a perspective view of a removable power module.

FIG. 6 is a similar view of a power module according to a modification of the invention for use in forced air heating systems.

DETAILED DESCRIPTION

Figure 1:
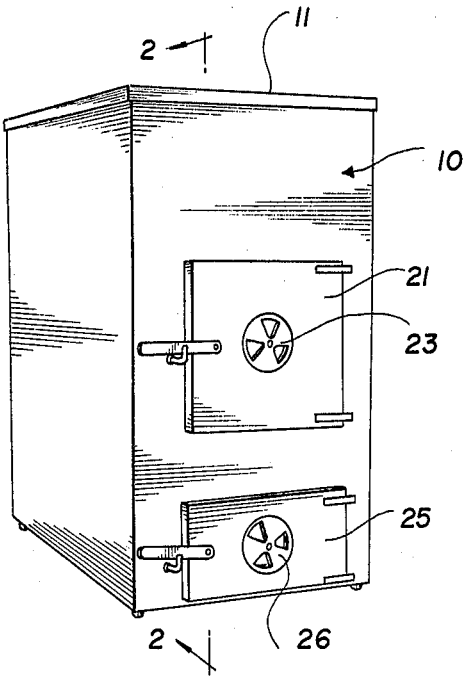
FIG. 1 is a perspective view of a boiler embodying the invention.
Figure 2:
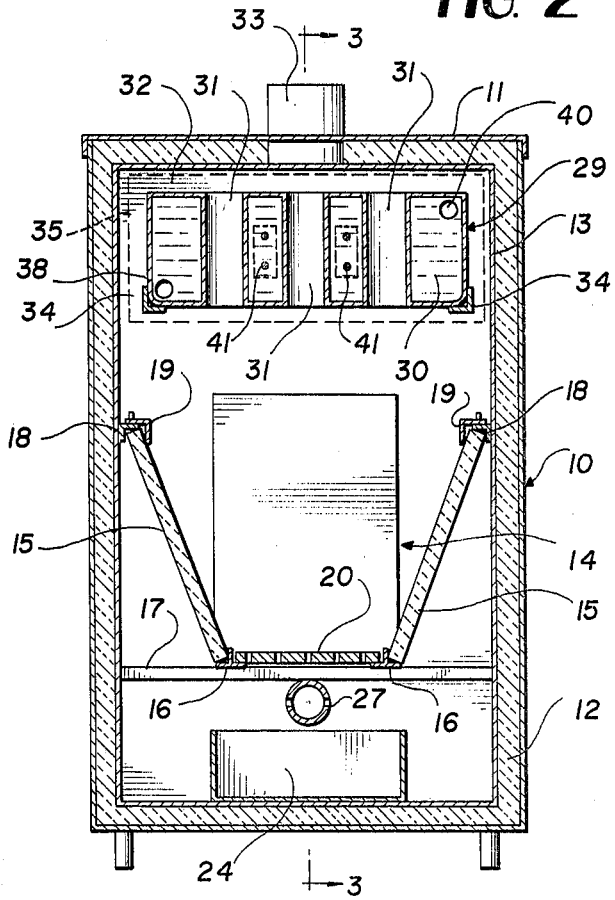
FIG. 2 is an enlarged transverse vertical section taken on line 2—2 of FIG. 1.
Figure 3:
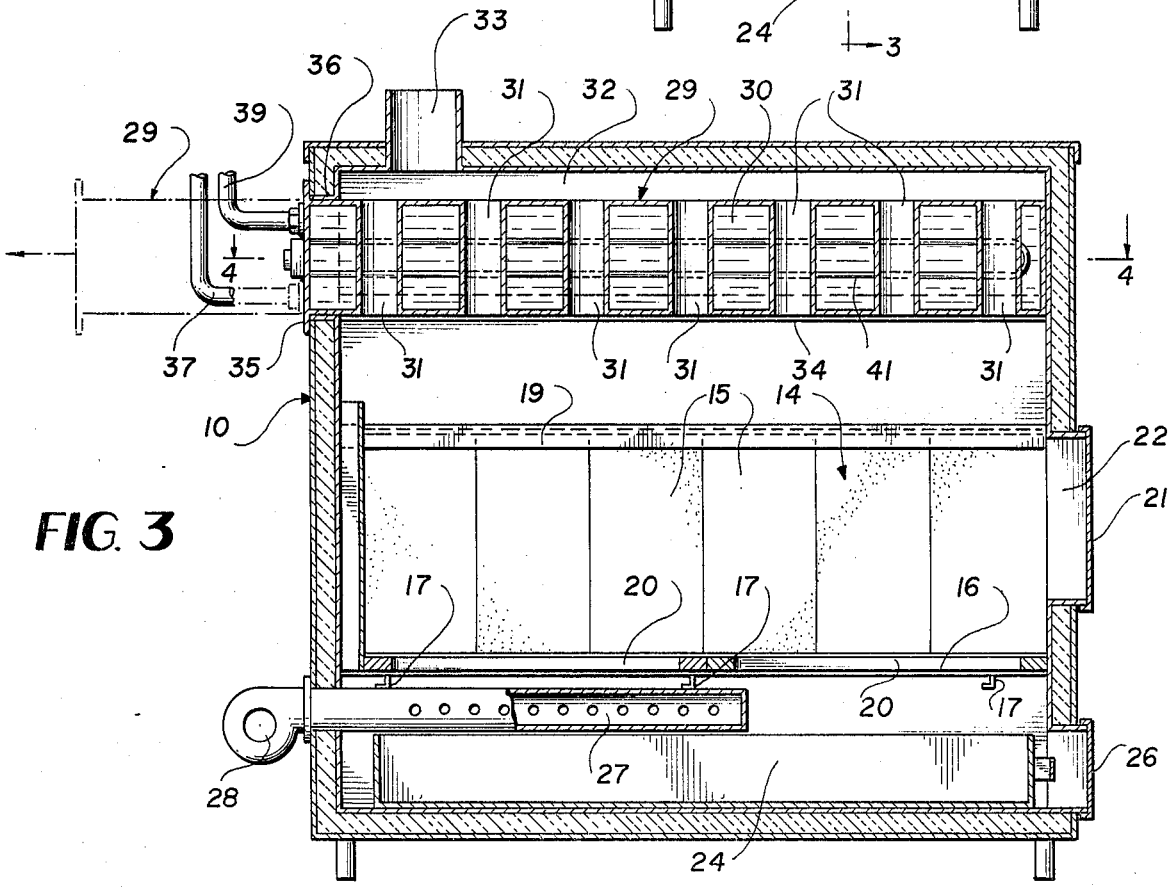
FIG. 3 is a central vertical longitudinal section through the boiler taken on line 3—3 of FIG. 2.

Referring to the drawings in detail wherein like numerals designate like parts, a boiler in accordance with the invention comprises a rectangular outer shell 10 including front, side, rear and bottom walls and a removable top wall 11. The shell 10 can be thermally insulated as indicated by the numeral 12 on all of its walls as found desirable and such insulating material is contained between the outer shell 10 and a suitable inner shell 13 of like shape. Centrally of the boiler, a fire box 14 is provided extending between the front and rear walls of the boiler as shown in FIG. 3. This fire box is defined by upwardly diverging refractory walls consisting of replaceable fire bricks 15 arranged in edge-to-edge abutting relationship. The bottoms of the fire bricks 15, FIG. 2, rest on sturdy inverted T-bars 16 extending between front and back walls of the boiler and supported on firmly anchored cross members 17. The upper edges of the fire bricks 15 rest against angle bars 18 on the side walls of the inner shell 13 and are further held in fixed relationship by front-to-back retainer angle bars 19. The top of the fire box 14 is essentially wide open between the retainers 19.

A sturdy cast iron grate 20 preferably formed in at least two sections rests on the horizontal webs of the same pair of bars 16 which support the fire bricks 15. The construction is extremely simplified and very sturdy and the parts forming the fire box 14 are readily replaceable when required.

The boiler is provided with a large rectangular wood feeder door 21 on its forward side adjacent to a large access opening 22 at the front of the fire box through which wood can be conveniently placed in the fire box or chamber 14. The door 21 is equipped with a check draft device 23, as illustrated.

A large ash receiver pan 24 is provided on the bottom wall of the shell 10 directly below and spanning the grate 20 transversely and longitudinally. A front ash clean-out door 25 having a manual draft device 26 is provided adjacent to the pan 24 so that the latter can be easily removed for emptying at required times.

An apertured forced draft tube 27 is disposed immediately below the grate 20 at the transverse center of the boiler and extends from a point near the longitudinal center of the boiler, FIG. 3, toward and through the rear wall of the shell 10 where it is connected exteriorly of the boiler with an optional blower 28. The draft tube 27 extends just above the top of the ash collection pan 24.

A rectangular horizontal slide-in slide-out boiler power module 29 constitutes a very important feature of the invention. The module 29 comprises an essentially closed rectangular hot water chamber 30 having top, bottom, side and end walls. A multiplicity of vertical axis open-ended fire tubes 31 arranged in spaced front-to-back rows extend through the closed water chamber 30 and are sealed by welding from communication with such chamber. The hot products of combustion rising from the fire box 14 pass directly upwardly through the rows of fire tubes 31 to a shallow combustion products chamber 32 immediately above the power module 29 and from this chamber 32 through a rising smoke pipe 33 located near the rear wall of the boiler. The elongated module 29 with its rows of fire tubes 31 spans the boiler for its full length between the front and back walls thereof as does the underlying fire box 14.

The power module 29 is supported slidably on fixed support and guide rails 34 above the fire box. The rear wall 35 of the power module 29 laps the rear wall of boiler casing 10 adjacent to a rear opening 36 in such wall through which the power module can move so that the same can readily be removed at any time for cleaning and/or repairs, as required.

Cold water returning from house radiators passes through a return line 37, FIG. 3, coupled into an opening 38, FIG. 5, near one lower corner of the water chamber 30. A hot water supply line 39 leading to radiators in the heating system is similarly coupled into a hot water outlet opening 40 near the upper corner of the power module 29 diagonally opposite the return opening 38.

The arrangement is such that return water from the heating system continually enters the fire tube boiler through the opening 38 and is heated in the hot water chamber 30 by heat exchange relationship with the hot gases flowing upwardly through the fire tubes 31. After such heating, the hot water is delivered through the opening 40 and line 39 directly to radiators where the invention is serving as a primary heating boiler or source. Where it is serving as a booster boiler, the hot water in the line 39 will pass to the water heating coil or chamber of the primary heating boiler, not shown, such as an oil or gas fired boiler so that the primary boiler will accordingly burn less gas or oil under control of the customary aquastat.

In the event that wood or other solid fuel might not be readily available, heat energy from one or more electrical heating elements 41 can be utilized to heat the water in the chamber 30. The elements 41 are suitably connected at 42 through the rear wall 35 of the power module and extend longitudinally through the water chamber 30 of the boiler between the rows of fire tubes 31, as shown. This arrangement gives the boiler an added capability for heating in emergency situations.

In FIG. 6, a modified type of removable power module 29' is illustrated having the same rows of fire tubes 31 extending from top-to-bottom thereof across an open-ended air passage 43 which can receive air directly from an air duct 44, such as the return cool air duct in a forced air home heating system. Such air flowing through the open passage 43 is placed in heat exchange relationship with the hot gases rising through the fire tubes 31 and after being heated is delivered through a connected air duct 45 at the downstream end of the power module 29' to the heating registers of the forced air system. Except as described, the module 29' operates in the same manner as the module 29 of the preceding embodiment and the construction of the device in FIGS. 2 and 3 remains unchanged except as described in connection with FIG. 6.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A boiler comprising a rectangular shell, an upwardly open fire box arranged centrally in said shell and including a bottom horizontal grate and refractory side walls rising from said grate, an ash collection receptacle disposed in said shell below said grate, access doors on said shell adjacent to said fire box and said receptacle, a slide-in slide-out power module disposed horizontally in said shell above said fire box and being bodily removable from the shell through an opening provided in one wall of the shell, said power module having a multiplicity of open-ended substantially vertical fire tubes formed therethrough in the vertical direction, said fire tubes receiving hot gaseous combustion products from the open top of the fire box and passing the same in heat exchange relationship with a heating fluid being circulated continuously through said power module, exhaust means for spent gaseous combustion products opening through the top wall of said shell, said slide-in slide-out power module further comprising a substantially closed water heating chamber surrounding said fire tubes and having connections with return water and hot water supply means in a hot water heating system, and at least one electrical heating element extending within said water heating chamber in the region between adjacent rows of said fire tubes and having a connection through one end wall of said power module.

2. A boiler comprising a rectangular shell, a fire box within the shell defined by a horizontal grate and refractory side walls consisting of fire bricks rising from opposite sides of the grate and lying in two upwardly diverging planes and having top edges terminating at a common elevation well below the top of the shell, common support members for the grate and lower edges of the fire bricks extending in the front-to-back direction in the shell and spaced inwardly from the side walls of the shell in parallelism, retainer means for the top edges of the fire bricks within the shell secured to the side walls of the shell and being in parallelism at a common elevation, a boiler module including a fluid chamber removably mounted in the shell above the elevation of the fire box, and an ash receptor means in the shell below the elevation of the grate.

3. A boiler as defined in claim 2, and the ash receptor means including a removable ash receptacle.

4. A boiler as defined in claim 2, and said boiler module comprising a horizontally sliding module of shallow rectangular configuration having multiple vertical fire tube passages formed therethrough from top to bottom with said fluid chamber surrounding the fire tube passages, a pair of front to back parallel support rails for the boiler module within the shell near the top of the shell, and the shell having a rear opening for the insertion and removal of the boiler module from the shell, the boiler module when in the shell extending for substantially the entire front to back dimension of the shell and being substantially coextensive in the front to back direction with the fire box and grate.

5. A boiler comprising a rectangular shell, a fire box means within the shell including a horizontal grate and side walls consisting of fire bricks rising from opposite sides of the grate and lying in two upwardly diverging planes and having top edges terminating at a common elevation below the top of the shell, common support members for the grate and lower edges of the fire bricks extending in the front to back direction in the shell, retainer means for the top edges of the fire bricks and being secured to the side walls of the shell and extending in the front to back direction in relation to the shell, and a boiler module including a fluid chamber removably mounted in the shell above the elevation of the fire box means.

* * * * *